US009849349B1

(12) United States Patent
Westrum et al.

(10) Patent No.: US 9,849,349 B1
(45) Date of Patent: Dec. 26, 2017

(54) IRON-TYPE GOLF CLUB HEAD WITH LIGHTWEIGHT HOSEL

(71) Applicant: Callaway Golf Company, Carlsbad, CA (US)

(72) Inventors: Joshua D. Westrum, Vista, CA (US); Irina Ivanova, San Marcos, CA (US); Scott R. Manwaring, Carlsbad, CA (US); Brooks Roche, Ramona, CA (US); Bradley C. Rice, Carlsbad, CA (US); William C. Watson, Temecula, CA (US); Broadus Perry Wall, Jr., Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/192,574

(22) Filed: Jun. 24, 2016

(51) Int. Cl.
*A63B 53/02* (2015.01)
*A63B 53/04* (2015.01)

(52) U.S. Cl.
CPC ..... *A63B 53/02* (2013.01); *A63B 53/047* (2013.01); *A63B 2053/042* (2013.01); *A63B 2053/0408* (2013.01)

(58) Field of Classification Search
CPC .... A63B 2053/0412; A63B 2053/0408; A63B 53/047; A63B 53/02; A63B 2053/042
See application file for complete search history.

(56) References Cited

U.S. PATENT DOCUMENTS

| | | | | | |
|---|---|---|---|---|---|
| 3,655,188 | A * | 4/1972 | Solheim | A63B 53/04 | 473/290 |
| 6,045,456 | A * | 4/2000 | Best | A63B 53/04 | 473/291 |
| 6,875,124 | B2 * | 4/2005 | Gilbert | A63B 53/04 | 473/290 |
| 6,923,734 | B2 * | 8/2005 | Meyer | A63B 53/047 | 473/336 |
| 7,066,834 | B2 * | 6/2006 | Yamamoto | A63B 53/047 | 473/342 |
| 7,144,337 | B2 * | 12/2006 | Hirano | A63B 53/047 | 473/329 |
| 7,147,571 | B2 * | 12/2006 | Best | A63B 53/047 | 473/291 |
| 7,722,479 | B2 | 5/2010 | Soracco | | |
| 7,819,757 | B2 * | 10/2010 | Soracco | A63B 53/04 | 473/332 |
| 8,491,412 | B2 * | 7/2013 | Roach | A63B 53/047 | 473/332 |
| 9,427,635 | B2 * | 8/2016 | Ines | A63B 53/047 | |
| 2004/0082401 | A1 | 4/2004 | Takeda | | |
| 2005/0009630 | A1 * | 1/2005 | Chao | A63B 53/0466 | 473/342 |

* cited by examiner

*Primary Examiner* — Stephen Blau
(74) *Attorney, Agent, or Firm* — Rebecca Hanovice; Michael Catania; Sonia Lari

(57) ABSTRACT

The present invention relates to an iron-type golf club head having a hollow body cavity, a hosel with a shaft-receiving bore that communicates with the hollow body cavity to form a continuous cavity structure, and a center of gravity located closer to the toe than to the heel. The iron-type golf club head preferably includes a face component with a striking face and a rear extending sole portion, and may also include supporting ribs within the continuous cavity structure, a hosel cutout covered by a cover made from a lower-density material than that of the hosel, and through-holes extending through a wall of the hosel.

17 Claims, 11 Drawing Sheets

IRON-TYPE GOLF CLUB HEAD WITH LIGHTWEIGHT HOSEL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates generally to an iron-type golf club head with a lightweight hosel having a shaft bore that communicates with an interior cavity of the club head.

Description of Related Art

The USGA Rules of Golf limit set forth certain structural limits for conforming golf clubs. For example, Appendix II, Rule 2(c) states that, for non-putter clubs, a "shaft must be attached to the clubhead at the heel either directly or through a single plain neck and/or socket. The length from the top of the neck and/or socket to the sole of the club must not exceed 5 inches (127 mm), measured along the axis of, and following any bend in, the neck and/or socket." In view of these requirements, the hosel centers great deal of mass in the heel of the golf club head, particularly in iron-type golf club heads, which typically have smaller volumes than wood-type heads and require greater structural support at the hosel. There is a need to reduce the mass in the hosel region of iron-type golf club heads to increase the amount of discretionary mass available to a golf club manufacturer, move the center of gravity of the golf club head away from the heel, and thereby make such iron-type golf club heads more forgiving to golfers.

BRIEF SUMMARY OF THE INVENTION

The present invention relates to a golf club head having a lightweight hosel, and in particular an iron-type golf club head having a hosel bore that communicates with an interior cavity of the golf club head and a center of gravity located on a toe side of the geometric center of the face along a horizontal Y axis.

One aspect of the present invention is an iron-type golf club head comprising a head body having a top portion, a bottom portion, a heel portion, a toe portion, a rear portion, a front opening, and a heel edge portion, a face component comprising a striking face portion, a hosel comprising a tube body with a tube wall and a bore, and a flange section located at an interface between the head body and the tube body, wherein the top portion, bottom portion, heel portion, toe portion, and rear portion define a hollow interior, wherein the face component closes the front opening, wherein a heel side of the striking face portion abuts the heel edge portion, wherein the bore extends into and communicates with the hollow interior, wherein the bottom portion has a width of less than 1.5 inches, and wherein the iron-type golf club head has a mass of 220 grams to 320 grams and a loft of at least 16 degrees.

In some embodiments, the heel edge portion may be disposed at the flange section. In other embodiments, the tube wall may comprise a plurality of through-bores, which may have the same or differing geometric shapes. In another embodiment, the golf club head may further comprise a hosel cover, the tube wall may comprise at least one opening, and the hosel cover may be sized to close the at least one opening. In a further embodiment, the body and the hosel may be composed of a first metal material having a first density, the hosel cover may be composed of a second metal material having a second density, and the second density may be lower than the first density. In another embodiment, the face component may comprise a sole portion extending away from the striking face portion, the bottom portion of the head body may comprise a cutout, and the sole portion of the face component may extend into the cutout.

In still other embodiments, the iron-type golf club head may further comprise at least one rib disposed on an interior surface of the head body in the hollow interior and extending onto an interior surface of the tube body above the flange section. In a further embodiment, the at least one rib may comprise a first rib and a second rib, and the first rib may intersect the second rib, which may be disposed at the flange section. In another embodiment, the second rib may be disposed above the flange section. In some embodiments, the iron-type golf club head may further comprise a high density insert, the body may comprise a pocket sized to receive the high density insert, and the pocket may be disposed in the rear portion of the body. In a further embodiment, the pocket may be disposed in the toe portion of the body.

In some embodiments, the hosel may be integrally formed, forged, machined, cast, or otherwise manufactured with the head body. In other embodiments, the face component may be composed of a titanium alloy, which may be selected from the group consisting of 6-4 and 811, and the head body may be composed of steel, which may be selected from the group consisting of 17-4, 450, 475, 1020, and 1025. In a further embodiment, the face component may be brazed to the head body. In any of the embodiments, the striking face portion may not comprise a bulge or a roll, and the iron-type golf club head may comprise a center of gravity depth relative to a face plane of 0.010 to 0.350 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention relates to an iron-type golf club head having a lightweight hosel, and particularly a hosel with a shaft receiving bore that communicates with an interior golf club head cavity.

Figure 1:
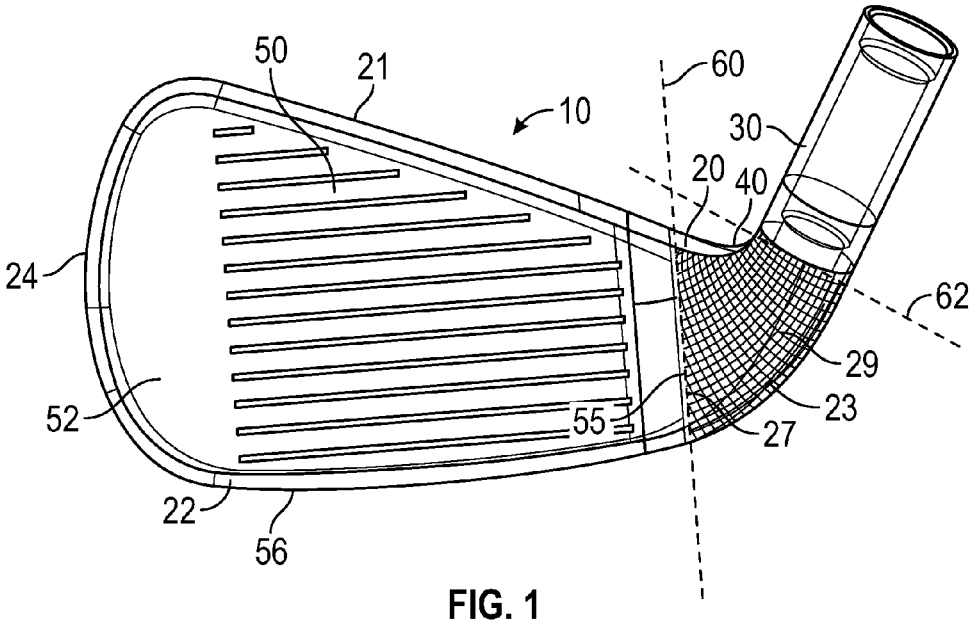
FIG. 1 is a front elevational view of a golf club head according to a first embodiment of the present invention.
Figure 2:
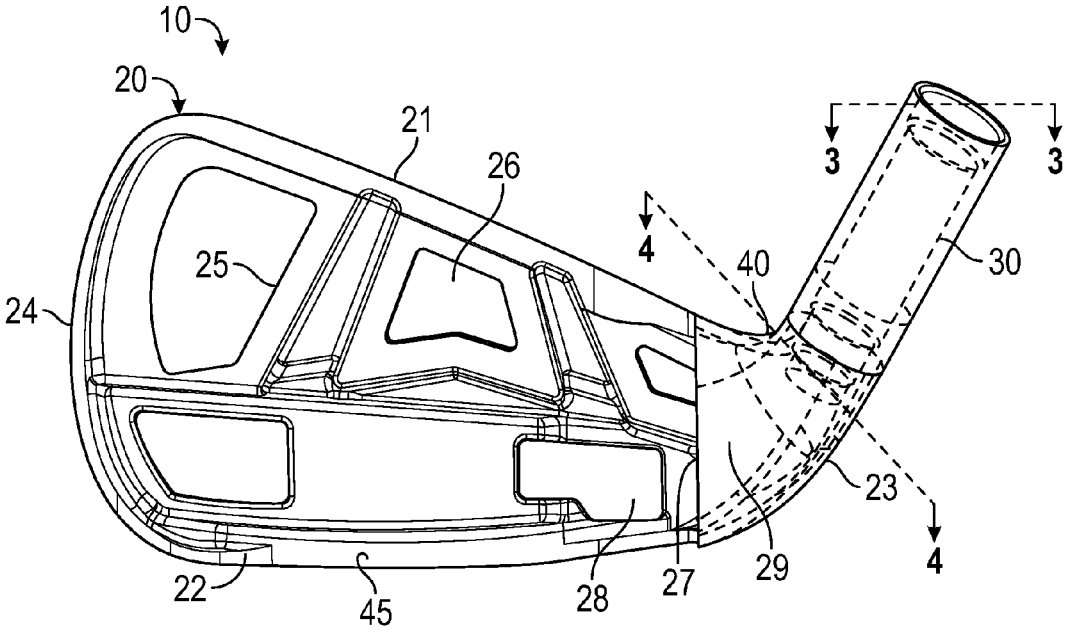
FIG. 2 is a front elevational view of the golf club head shown in FIG. 1 without its face component.

A preferred embodiment of the present invention is shown in FIGS. 1-4. In this embodiment, the golf club head 10 has a body 20 having a top portion 21, a bottom portion 22, a heel side 23, a toe side 24, a rear side 25, a front opening 26, a heel edge portion 27 where the front opening 26 ends, and a hollow interior 28 defined by the other features of the body 20 and by the face component 50. The body is connected to a hosel 30, which extends from a flange section 40 at the heel side 23, and which has a tube body 32 having a wall 34 and a bore 36 into which a shaft (not shown) can be inserted. The hosel 30 also includes abutment surfaces 38*a*, 38*b* against which the shaft can rest when engaged with the bore 36. The flange section 40 is a transition between the body 20 and the hosel 30 and is defined as the region where the body 20 stops tapering downward in size and meets the hosel 30. The face component 50 comprises a striking surface 52 that does not include a bulge or a roll, a rear surface (not shown) opposite the striking surface 52, and a sole portion 56 extending away from a bottom portion 53 of the striking surface 52 and into a cutout 45 in the bottom portion 22 of the body 20. As shown in FIG. 1, a heel side 55 of the striking surface 52 abuts the heel edge portion 27 of the body 20.

Figure 3:
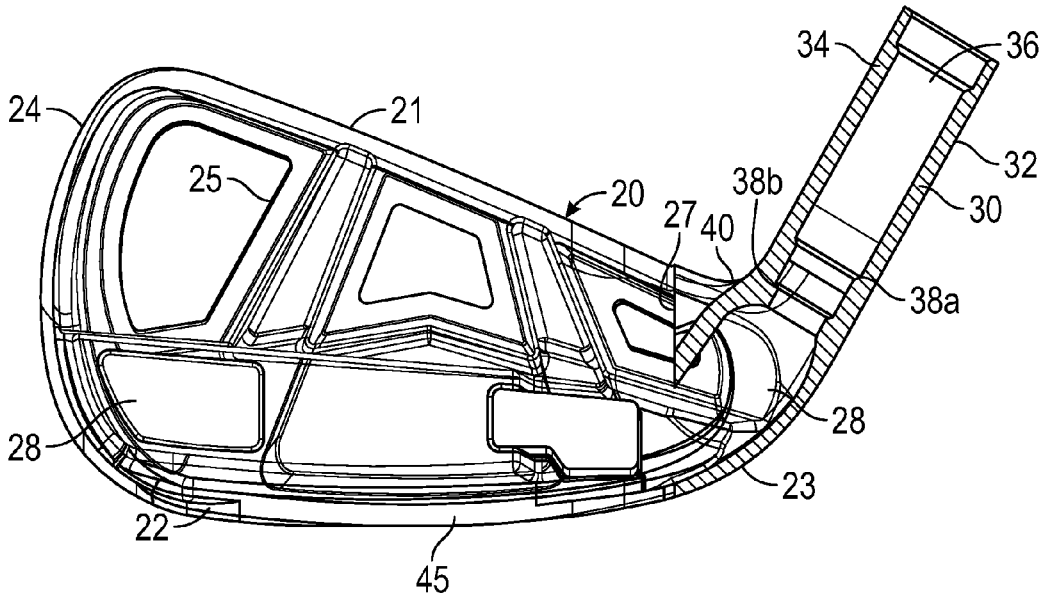
FIG. 3 is a cross-sectional view of the golf club head shown in FIG. 2 along lines 3-3.
Figure 4:
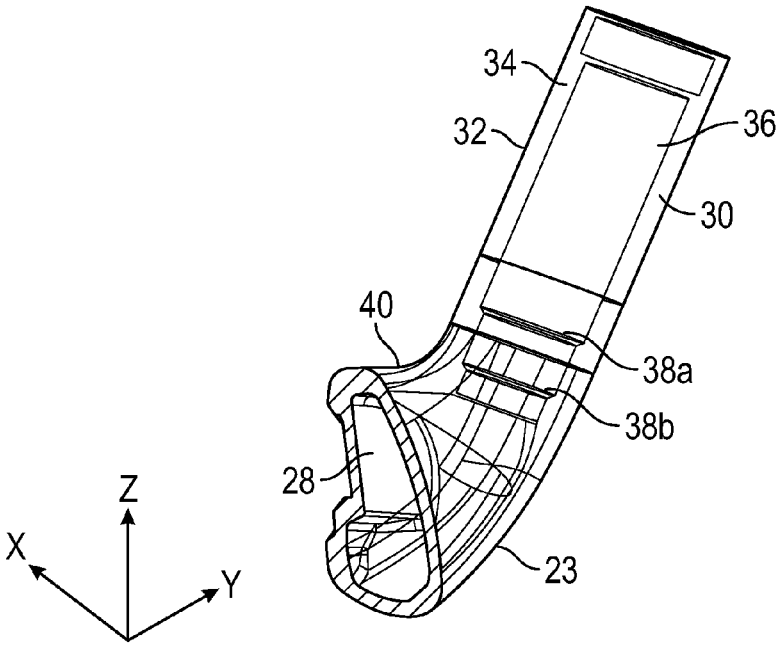
FIG. 4 is a cross-sectional view of the golf club head shown in FIG. 2 along lines 4-4.
Figure 5:
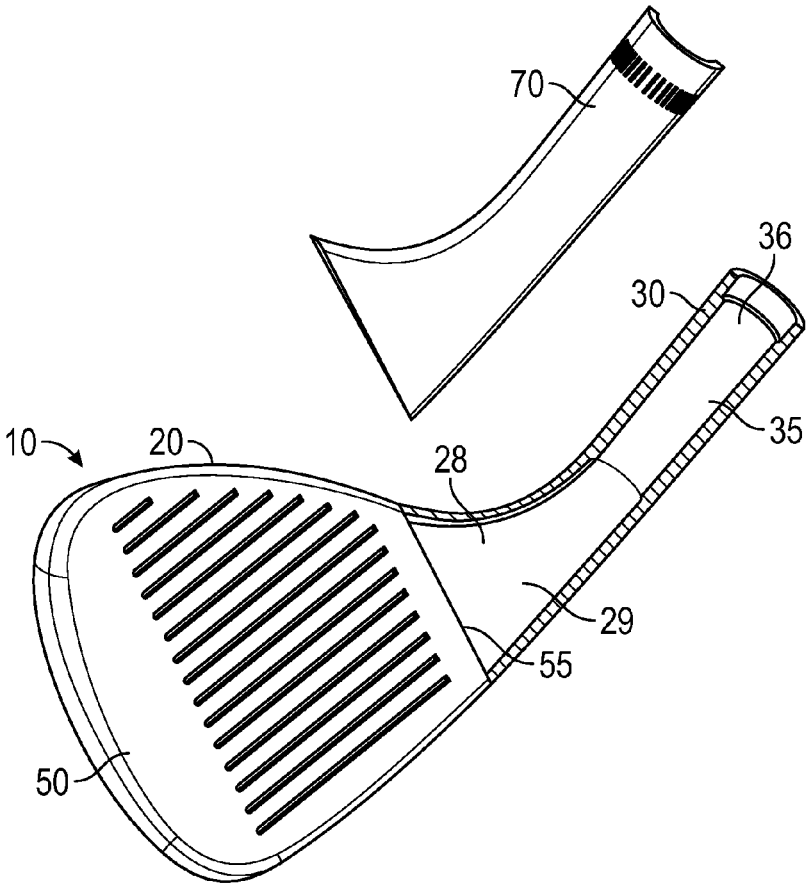
FIG. 5 is a front perspective view of a golf club head according to a second embodiment of the present invention.
Figure 6:
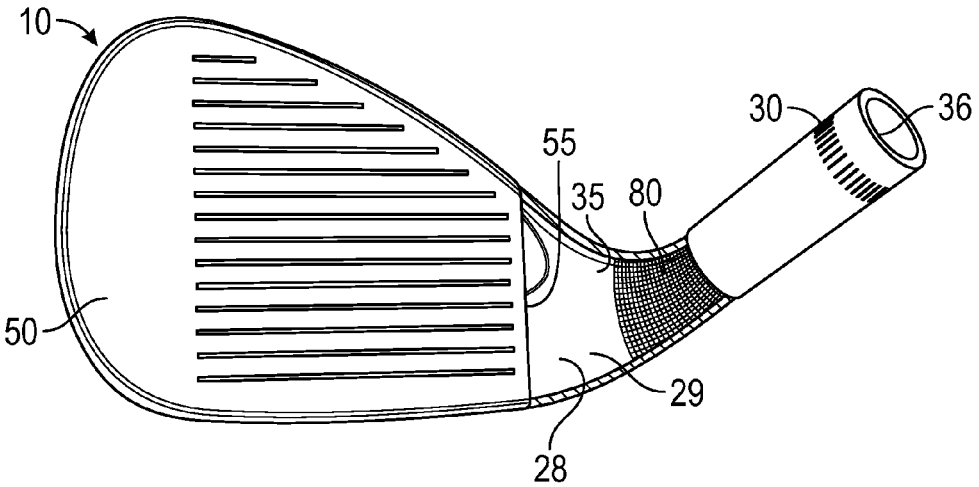
FIG. 6 is a front elevational view of a golf club head according to a third embodiment of the present invention.
Figure 7:
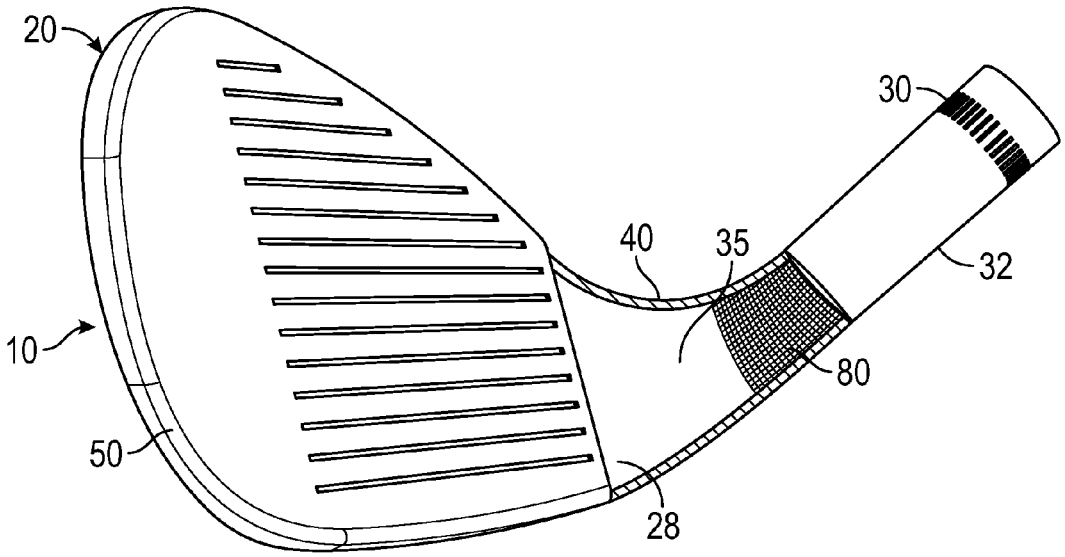
FIG. 7 is a side perspective view of the golf club head shown in FIG. 6.
Figure 8:
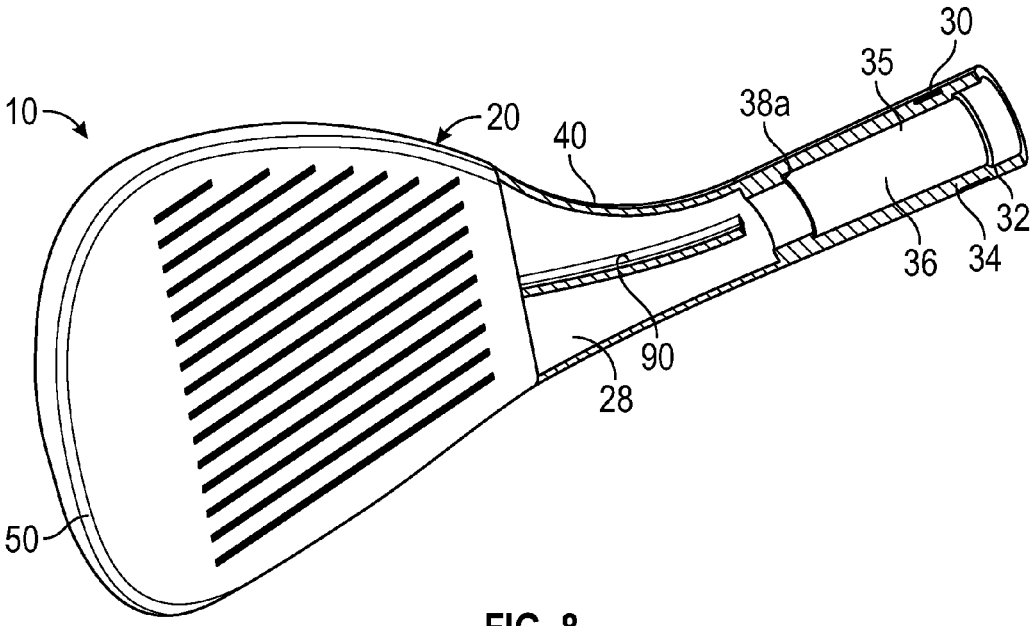
FIG. 8 is a side elevational view of a golf club head according to a fourth embodiment of the present invention.
Figure 9:
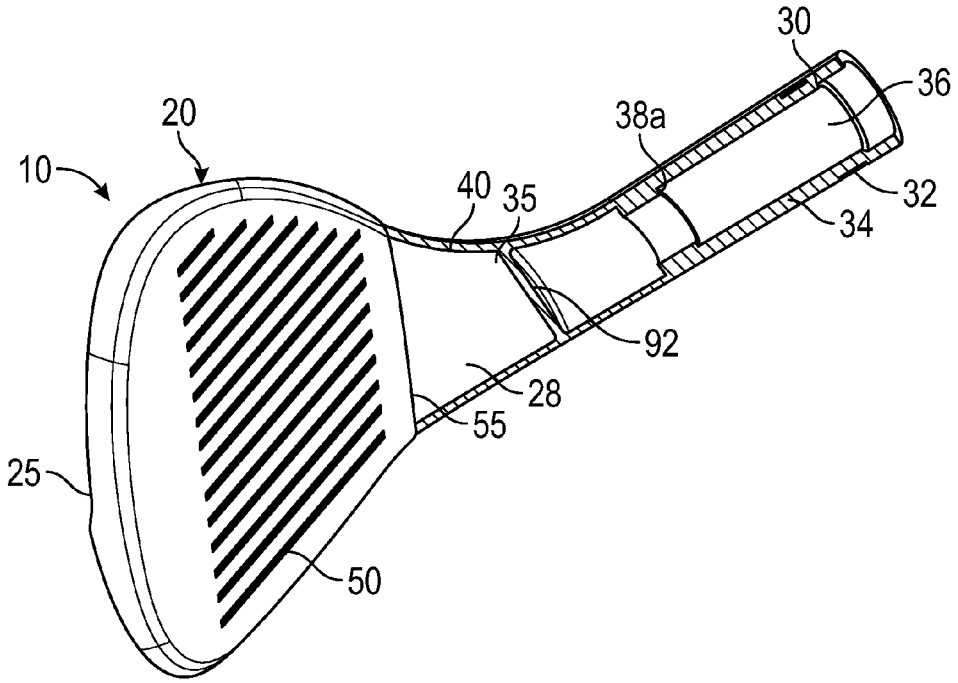
FIG. 9 is a side elevational view of a golf club head according to a fifth embodiment of the present invention.
Figure 10:
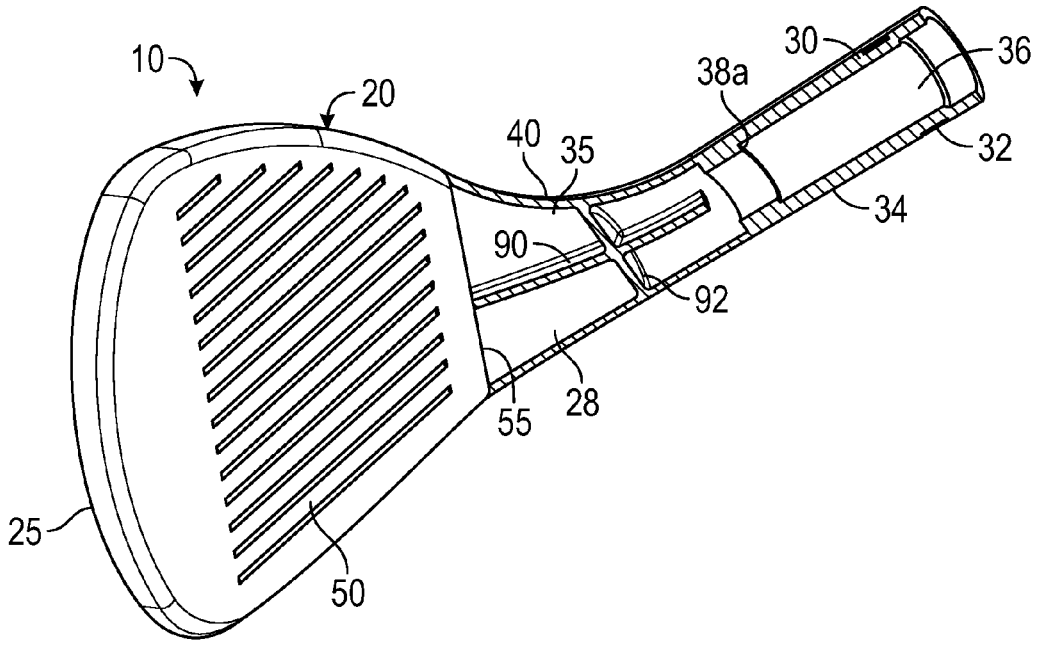
FIG. 10 is a side elevational view of a golf club head according to a sixth embodiment of the present invention.
Figure 11:
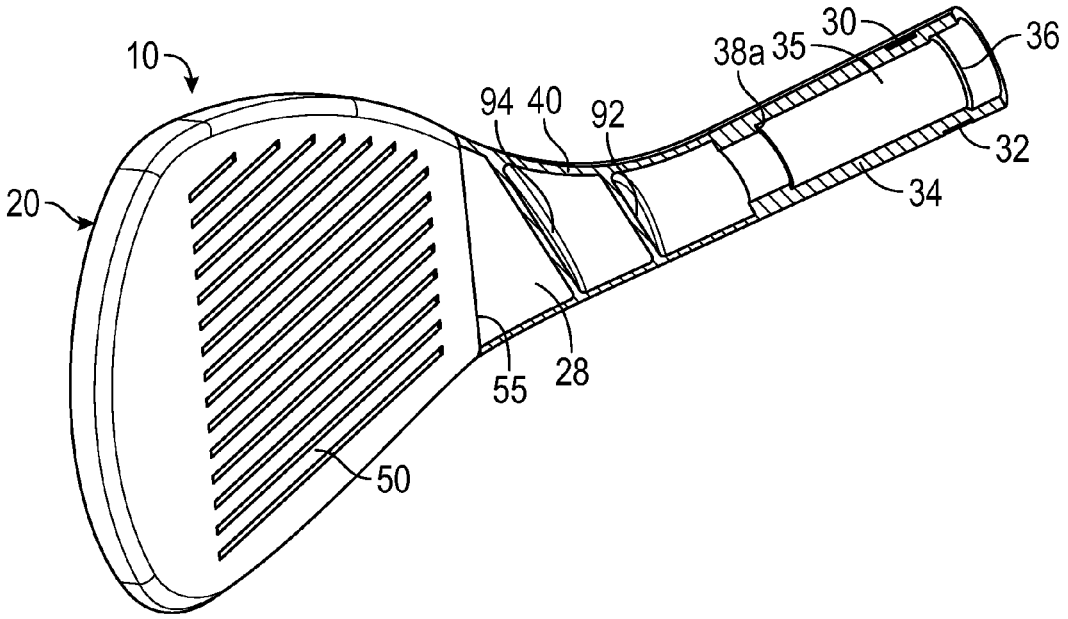
FIG. 11 is a side elevational view of a golf club head according to a seventh embodiment of the present invention.
Figure 12:
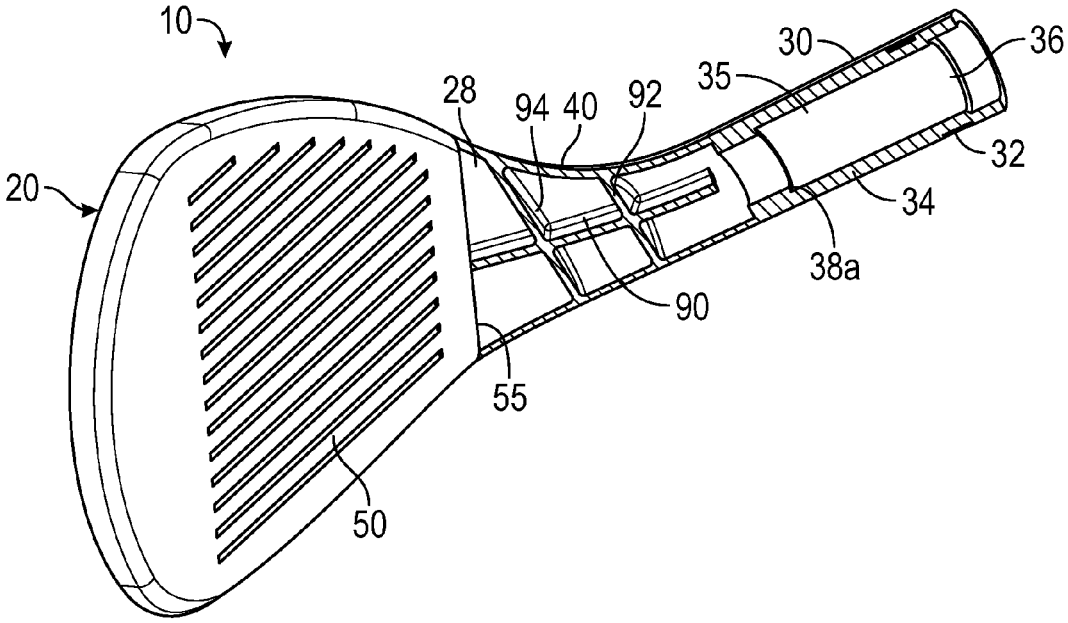
FIG. 12 is a side elevational view of a golf club head according to an eighth embodiment of the present invention.

An inventive feature of the preferred embodiment is the communication, i.e., continuity, between the bore 36 in the hosel 30 and the hollow interior 28 of the body 20, as shown in FIGS. 3 and 4. There is no barrier between these two empty spaces in the golf club head 10 of the present invention, and preferably the interior cavity 28 has a heel portion 29, defined by a first, vertical plane 60 extending through the heel edge portion 27 and a second, angled plane 62 extending through the base of the hosel 30 at the flange section 40, with a volume V of at least 2 cc. This continuity can be achieved when casting the golf club head 10 using a traditional pick method, water soluble core pieces, or a ceramic insert.

The preferred embodiment shown in FIGS. 1-4 preferably has a mass of 220-320 grams, a center of gravity depth along an X axis of 0.010 to 0.350 inch, a loft angle, defined as the angle at which the striking surface 52 lies relative to the shaft, of at least 16 degrees. The bottom portion 22 of the golf club head 10 preferably has a front-to-back length along the X axis of less than 1.5 inches, and the body 20 and hosel 30 preferably are integrally cast, or otherwise manufactured, as a unitary piece, though in alternative embodiments the hosel 30 may be welded or otherwise affixed to the body 20 after each part is separately manufactured. In the preferred embodiment, the face component 50 is manufactured separately from the body 20, and is composed of a different material than the body 20. In particular, the face component 50 is composed of a titanium alloy, such as 6-4 or 811 titanium, while the body 20 is composed of a steel material, such as 17-4, 450, 475, 1020, or 1025 steel, and the face component 50 is brazed to the body 20 to close the front opening 26 and cutout 45.

In other embodiments of the present invention, illustrated in FIGS. 5-13, the hosel 30 is further lightened by replacing a portion of its material with a lighter-weight material. In particular, the hosel 30 includes a large cutout portion 35, which may extend along the entire length of the hosel 30 up to the heel edge portion 27 of the body 20 as shown in FIGS. 5 and 8-13, or which may extend only from the heel edge portion 27 to a location proximate the abutment surfaces 38*a*, 38*b*. The cutout portion 35 preferably is located in a front-most side of the hosel 30 to move mass, and thus the center of gravity, rearward on the golf club head 10. The cutout portion 35 is closed using a hosel cover 70 made from a material having a lower density than that of the hosel 30, and preferably from a lighter-weight metal alloy such as aluminum or magnesium, that can be welded to the hosel 30. If the hosel cover 70 is made from a non-metal material such as carbon composite or plastic, it can be bonded to the body 20 with a permanent adhesive.

Figure 13:
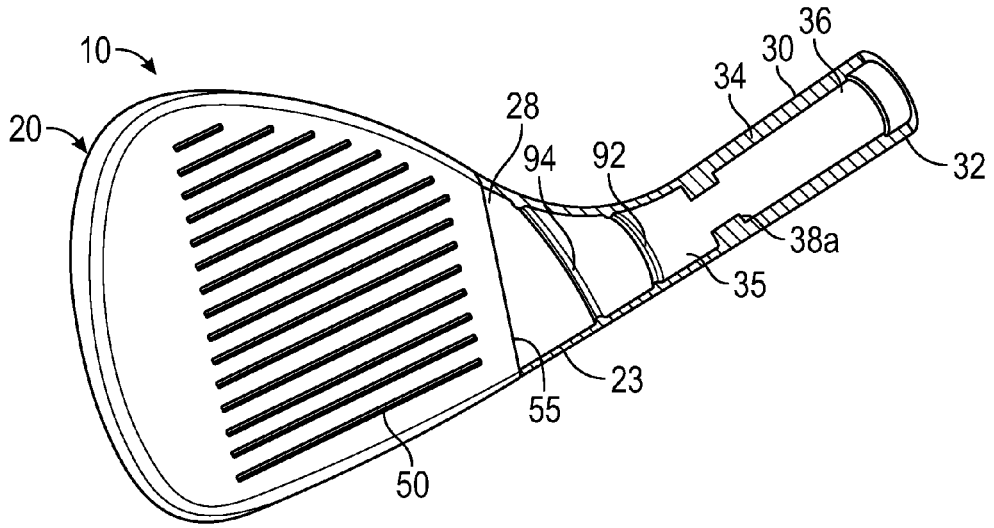
FIG. 13 is a side elevational view of a golf club head according to a ninth embodiment of the present invention.

The continuous hosel 30 bore 36 and interior cavity 28 structure of the present invention may be structurally supported by one or more internal ribs 90, 92, 94 that extend from the interior cavity 28 of the body 20 into the bore 36 of the tube body 32 and past the flange section 40, as shown in the embodiments of FIGS. 8-13. For example, in FIG. 8, a single rib 90 extends from the heel portion 29 of the interior cavity 28, preferably a location proximate the heel edge portion 27 or heel side 55 of the face component 50, and into the hosel 30 bore 36 proximate the abutment surface 38*a*. In an alternative embodiment, shown in FIG. 9, a single rib 92 is disposed within the golf club head 10 slightly above the flange section 40. In the embodiment shown in FIG. 10, the golf club head 10 includes both ribs 90, 92 shown in FIGS. 8 and 9, such that the ribs 90, 92 intersect with one another. In the embodiment shown in FIG. 11, two ribs 92, 94 extend parallel to one another within the golf club head 10 on either side of the flange section 40, and in the embodiment shown in FIG. 12, the two ribs 92, 94 are intersected by the elongated rib 90 extending from the interior cavity 28 into the hosel 30 bore 36. The ribs 90, 92, 94 disclosed herein may also be thinned as shown in FIG. 13, such that they take up less space within the golf club head 10 and free up additional discretionary mass.

Figure 14:
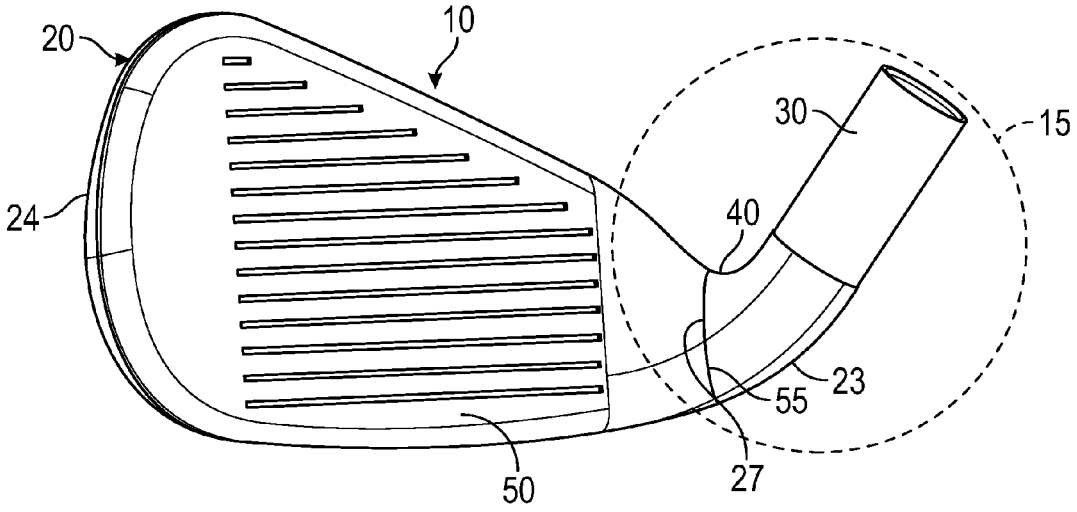
FIG. 14 is a front elevational view of a golf club head according to a tenth embodiment of the present invention.
Figure 15:
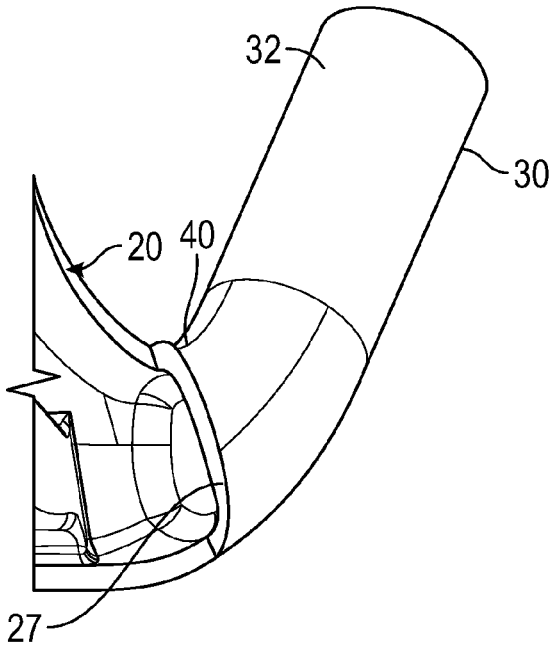
FIG. 15 is an enlarged view of the circled portion of the embodiment shown in FIG. 14 without its face component.
Figure 16:
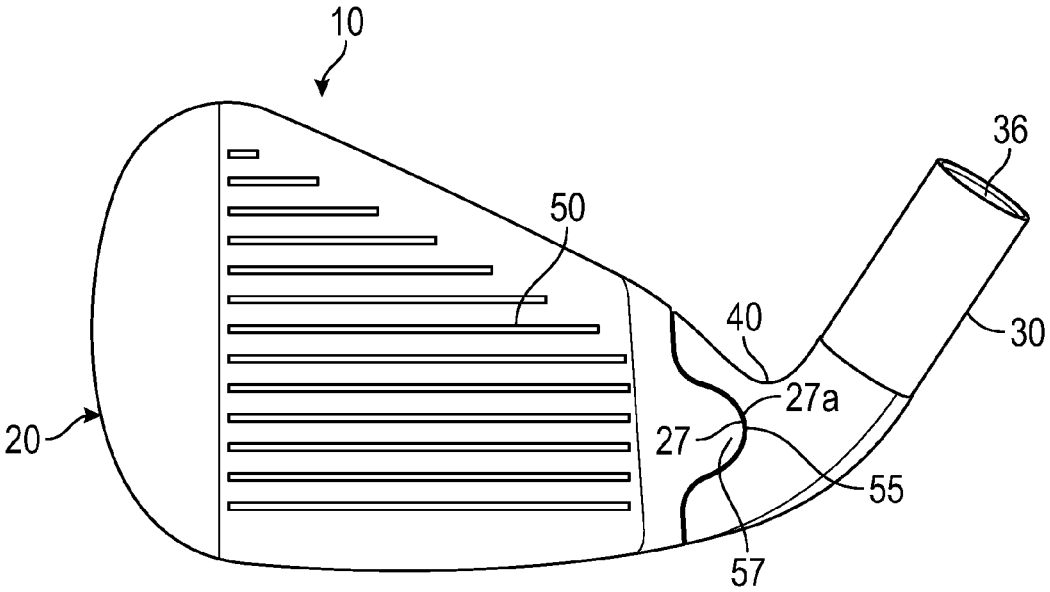
FIG. 16 is a front plan view of a golf club head according to an eleventh embodiment of the present invention.

In still other embodiments of the present invention, shown in FIGS. 14-16, the hosel 30 and heel side 23 of the golf club head 10 is further lightened by moving the heel edge portion 27, and thus the heel side 55 of the face component 50, further towards the hosel 30 tube body 32, such that it is located at, or close to, the flange section 40. As shown in FIG. 16, the edge portion may include a cutout 27*a* that is filled by an extension 57 from the heel side 55 of the face component. If the face component 50 is composed of a lighter weight or lower density material than that of the body 20, this construction frees up additional discretionary mass and moves that mass away from the heel side 23 of the golf club head 10.

Figure 17:
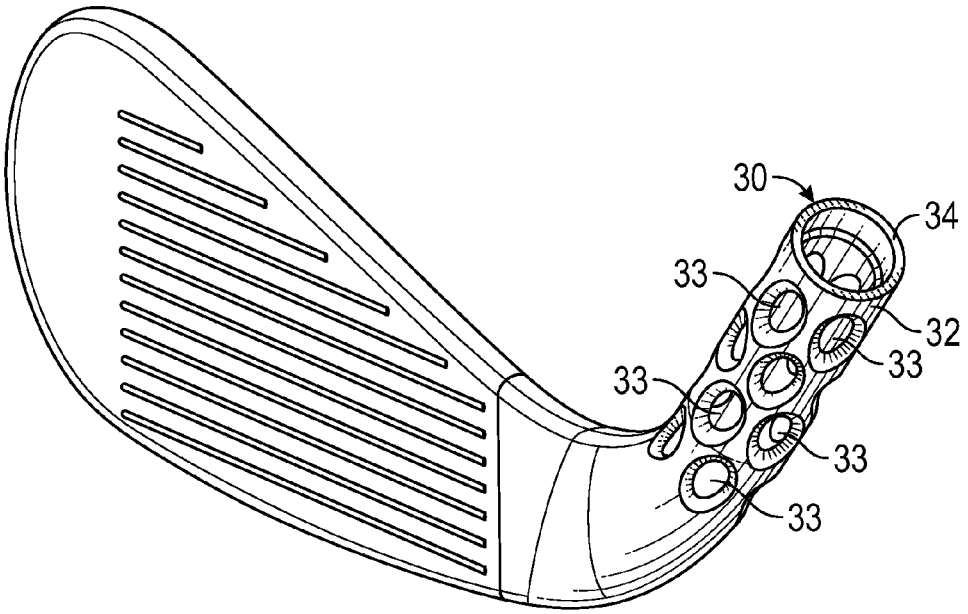
FIG. 17 is a side elevational view of a golf club hosel according to a twelfth embodiment of the present invention.

In another embodiment of the present invention, an example of which is shown in FIG. 17, the hosel 30 includes a plurality of geometric through-holes 33 extending through the wall 34 of the tube body 32. The tube body 32 may include any of the through-holes 33 disclosed in U.S. Design patent application No. 29/566,666, filed on Jun. 1, 2016, the disclosure of which is hereby incorporated by reference in its entirety herein, or any combinations thereof.

Figure 18:
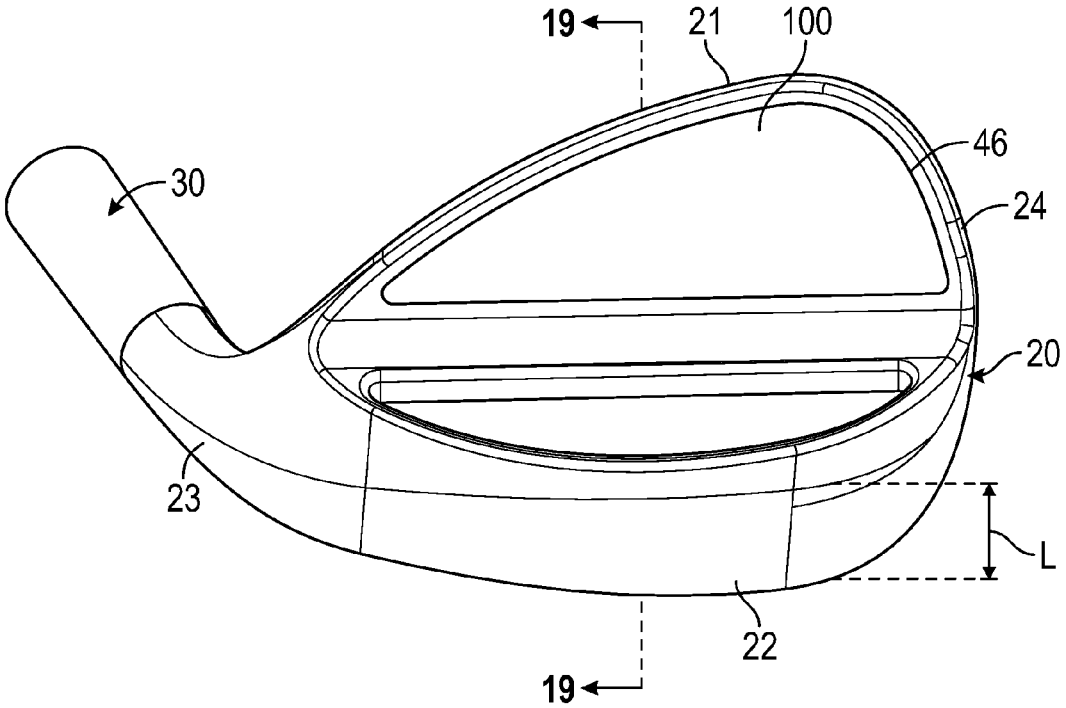
FIG. 18 is a rear elevational view of a golf club head according to a thirteenth embodiment of the present invention.
Figure 19:
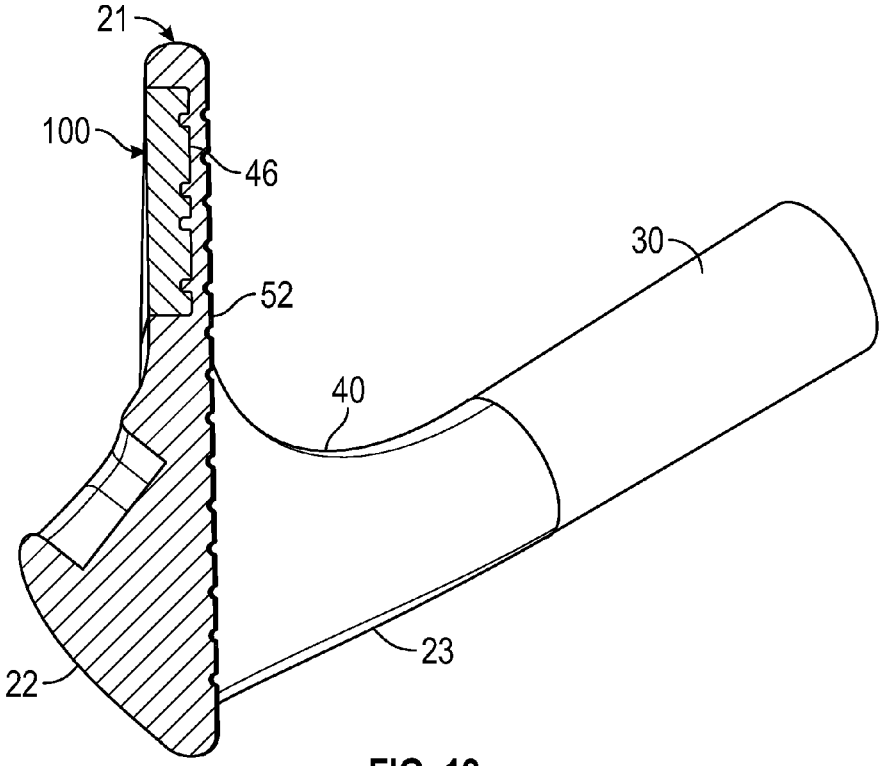
FIG. 19 is a cross-sectional view of the golf club head shown in FIG. 18 along lines 19-19.

As discussed herein, the hosel lightening concepts of the present invention serve at least two purposes: (1) moving mass away from the heel side 23 of the golf club head 10; and (2) moving the center of gravity rearward along the x axis, toe-ward along the y axis, and upward along the z axis. The second goal can be aided by the addition of a high-density insert 100 to the body 20, as shown in FIGS. 18-19. In this embodiment, the body 20 includes a pocket 46, which preferably extends into the rear side 25 at a location close to the top portion 21 and/or the toe side 24, sized to permanently or removably receive the high-density insert 100, which preferably is composed of a tungsten alloy.

Figure 20:
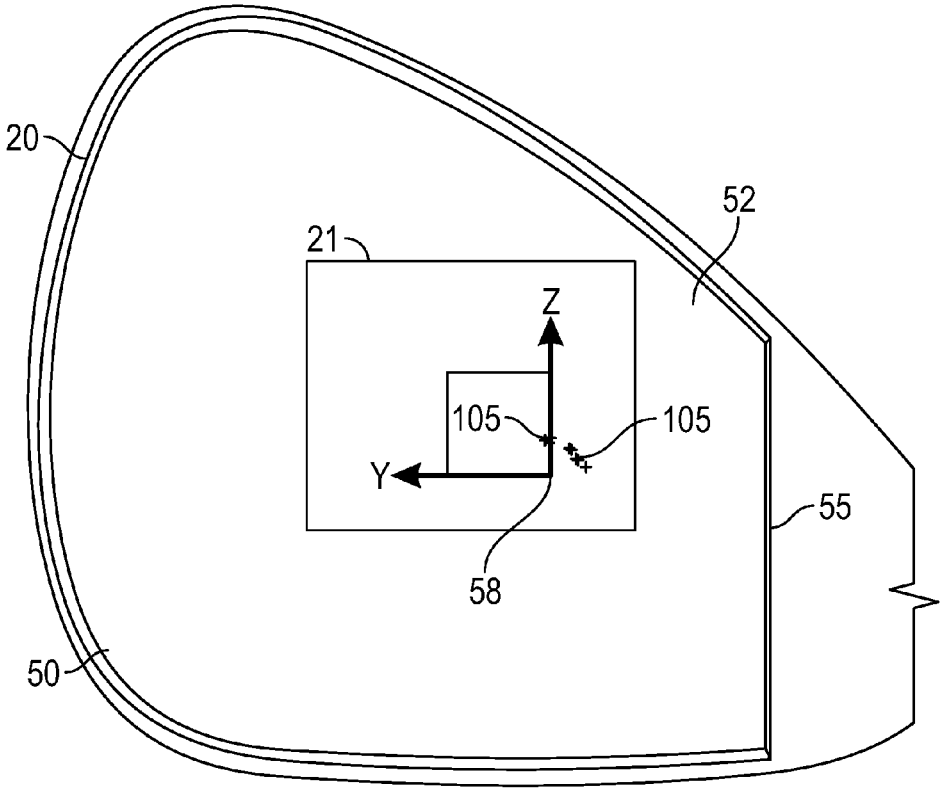
FIG. 20 is a front plan view of the golf club head shown in FIG. 1.
Figure 21:
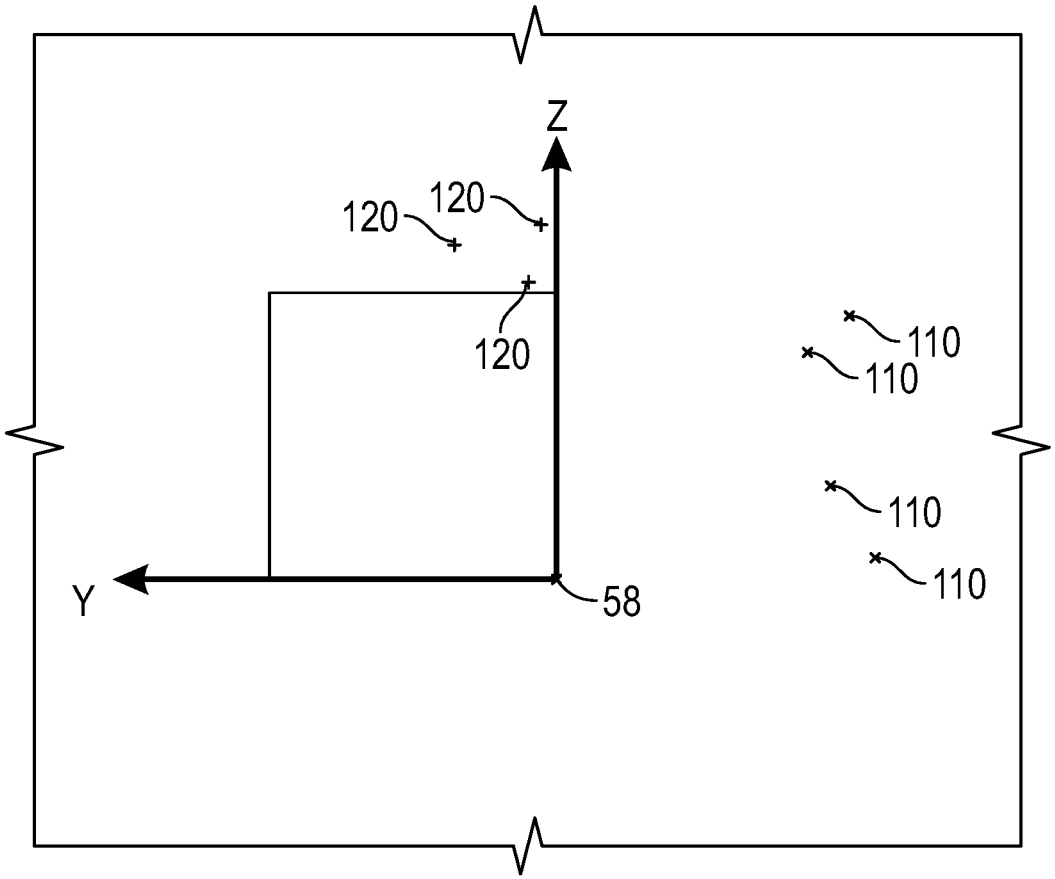
FIG. 21 is an enlarged view of the circled portion of the embodiment shown in FIG. 20.

As shown in FIGS. 20-21, including one or more of the embodiments shown in FIGS. 1-19 in an iron-type golf club head causes the center of gravity 105 to move toe-ward along the y axis and upward along the z axis with respect to a geometric face center 58. These Figures offer a comparison view of the centers of gravity measured from prior art iron-type golf club heads 110 and golf club heads 120 including the continuous hosel 30 bore 36 and interior cavity 28 structure of the present invention.

Any of the embodiments disclosed herein may be combined in an iron-type golf club head 10 to lighten and/or support the hosel 30 of the present invention. In any of the embodiments disclosed herein, the heel portion 29 of the body 20 (or other hollow portions of the body 20 or hosel 30) may be partially or completely filled with a dampening material 80, which may be polymeric (e.g., urethane or rubber) but preferably includes a wire mesh material, such as the material made by Kinetic Structures and described at the following website: http://www.kineticstructures.com/wire%20mesh%20friction%20damper.html.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron-type golf club head comprising:

a head body comprising a top portion, a bottom portion, a heel portion, a toe portion, a rear portion, a front opening, and a heel edge portion, the body composed of a steel material;

a face component comprising a striking face portion and a sole portion extending away from the striking face portion, the face component composed of a titanium alloy;

a hosel comprising:

a tube body comprising a tube wall; and a bore; and a flange section located at an interface between the head body and the tube body, wherein the top portion, bottom portion, heel portion, toe portion, and rear portion define a hollow interior, wherein the face component closes the front opening, wherein the bottom portion of the head body comprises a cutout, wherein the sole portion of the face component extends into and closes the cutout, wherein a heel side of the striking face portion abuts the heel edge portion, wherein the bore extends into and communicates with the hollow interior, wherein at least a heel portion of the hollow interior is filled with a wire mesh material, wherein the bottom portion has a width of less than 1.5 inches, wherein the iron-type golf club head has a mass of no less than 220 grams and no more than 320 grams, wherein the iron-type golf club head comprises a center of gravity depth along an axis perpendicular to a face plane of 0.010 to 0.350 inch, and wherein the iron-type golf club head has a loft angle of at least 16 degrees.

2. The iron-type golf club head of claim 1, wherein the heel edge portion is disposed at the flange section.

3. The iron-type golf club head of claim 1, wherein the tube wall comprises a plurality of through-bores.

4. The iron-type golf club head of claim 1, further comprising a hosel cover, wherein the tube wall comprises at least one opening, and wherein the hosel cover is sized to close the at least one opening.

5. The iron-type golf club head of claim 4, wherein the body and the hosel are composed of a first metal material having a first density, wherein the hosel cover is composed of a second metal material having a second density, and wherein the second density is lower than the first density.

6. The iron-type golf club head of claim 1, further comprising at least one rib, wherein the at least one rib is disposed on an interior surface of the head body within the hollow interior of the head body, and wherein the at least one rib extends onto an interior surface of the tube body above the flange section.

7. The iron-type golf club head of claim 6, wherein the at least one rib comprises a first rib and a second rib, and wherein the first rib intersects the second rib.

8. The iron-type golf club head of claim 7, wherein the second rib is disposed at the flange section.

9. The iron-type golf club head of claim 7, wherein the second rib is disposed above the flange section.

10. The iron-type golf club head of claim 1, further comprising a high density insert, wherein the body comprises a pocket sized to receive the high density insert.

11. The iron-type golf club head of claim 10, wherein the pocket is disposed in the rear portion of the body.

12. The iron-type golf club head of claim 10, wherein the pocket is disposed in the toe portion of the body.

13. The iron-type golf club head of claim 1, wherein the hosel is integrally cast with the head body.

14. The iron-type golf club head of claim 1, wherein the titanium alloy is selected from the group consisting of 6-4 and 811.

15. The iron-type golf club head of claim 1, wherein the steel is selected from the group consisting of 17-4, 450, 475, 1020, and 1025.

16. The iron-type golf club head of claim 1, wherein the face component is brazed to the head body.

17. The iron-type golf club head of claim 1, wherein the striking face portion does not comprise a bulge or a roll.

* * * * *